United States Patent [19]

Komatsu

[11] 4,010,508

[45] Mar. 8, 1977

[54] MOP SUITED FOR DUSTING CURVED SURFACES

[75] Inventor: Toshiyoshi Komatsu, Osaka, Japan

[73] Assignee: Duskin Franchise Co., Ltd., Osaka, Japan

[22] Filed: Feb. 20, 1976

[21] Appl. No.: 659,904

[52] U.S. Cl. ..... 15/104.94; 15/229 AP; 15/233

[51] Int. Cl.[2] ..... A47L 13/24; B25G 1/02

[58] Field of Search ..... 15/147 R, 147 A, 228, 15/229 AP, 229 BP, 233, 104.94; 401/289

[56] References Cited

UNITED STATES PATENTS

| | | | |
|---|---|---|---|
| 604,027 | 5/1898 | Dumble | 15/233 UX |
| 2,682,071 | 6/1954 | Linderoth | 15/147 A |
| 2,727,268 | 12/1955 | Hucke | 15/229 BP |

FOREIGN PATENTS OR APPLICATIONS

| | | | |
|---|---|---|---|
| 736,847 | 9/1955 | United Kingdom | 15/229 AP |

*Primary Examiner*—Daniel Blum
*Attorney, Agent, or Firm*—Sherman & Shalloway

[57] ABSTRACT

A handy mop comprising a mop holder and a mop swab; said mop holder being composed of an integrally molded foamed product of a synthetic resin or an elastomer having independent cells inside thereof and a non-permeable continuous skin layer on the outer surface; said mop holder having a grip extending in the lengthwise direction at the central part thereof and a pair of mop holding parts having an arcuate tip and a horse-shoe-shaped bottom at both edges in the lengthwise direction integrally with said grip; said mop holder having resiliency and flexibility sufficient to deflect a pair of mop holding parts inwardly and downwardly; said mop swab being composed of an oval base cloth, a number of mop cords fastened to the lower surface of said base cloth and impregnated with a dusting oil composition, and a pair of pockets provided at the upper surface and at both ends in the lengthwise direction of said base cloth; a pair of said holding parts of said mop holder being inserted into the pockets of said mop swab to attach the mop swab to the mop holder.

6 Claims, 7 Drawing Figures

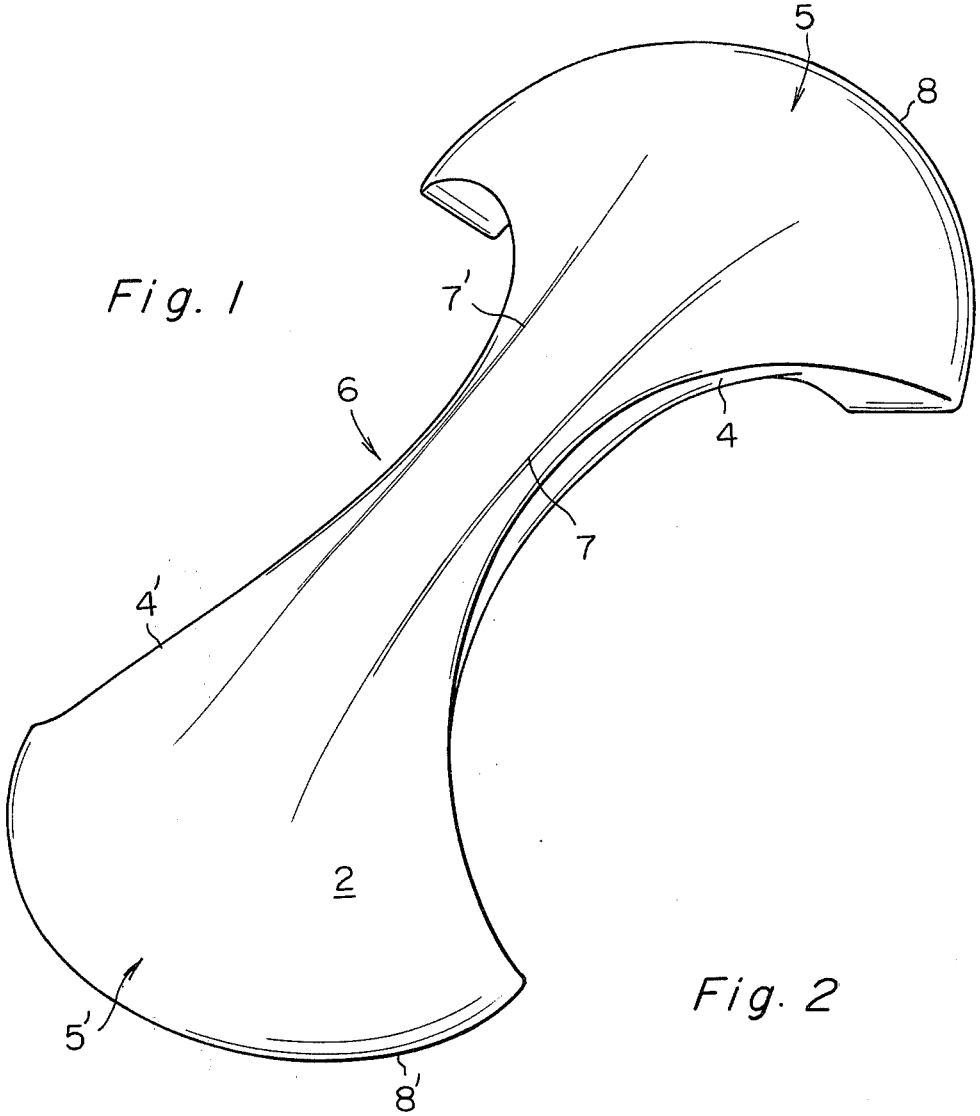
Fig. 1
Fig. 2
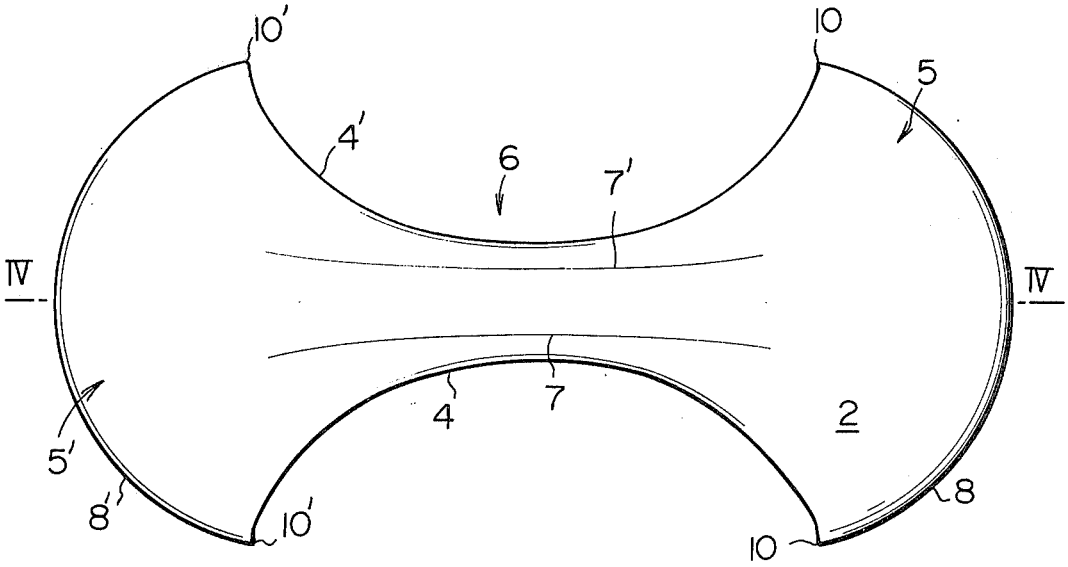

MOP SUITED FOR DUSTING CURVED SURFACES

This invention relates to a handy mop which is suited for dusting objects having curved surfaces, such as automobiles, and more particularly to a handy mop comprising a mop holder which is integrally formed of a foamed product of a synthetic resin or an elastomer and a mop swab which is detachably attached to said holder, wherein said mop is attached to said holder so that it can deform itself according to the curved surfaces of the object being cleaned, while giving tension to the curved surfaces.

Conventional holders for dusting mops comprises a frame for holding a mop swab and a handle attached to said frame. The frame is, usually, made of a wire or a sheet metal and rigidly attaches the mop swab to the frame. These mop holders are generally suited for cleaning flat surfaces such as floors, but apparently are not suited for dusting objects placed at positions higher than the floor, and especially for dusting curved surfaces such as of automobiles.

Therefore, it is an object of the present invention to provide a handy mop which is suited for dusting objects having convex surfaces such as of automobiles.

Another object of the invention is to provide a handy mop in which a mop swab is attached to a light mop holder, said mop swab being capable of undergoing deformation according to the curved surfaces of the object being cleaned and giving tension to the curved surfaces.

According to the present invention, there is provided a handy mop comprising a mop holder and a mop swab; said mop holder being composed of an integrally molded foamed product of a synthetic resin or an elastomer having independent cells inside thereof and a non-permeable continuous skin layer on the outer surface; said mop holder having upwardly convex spherical upper surface and lower surface; said mop holder having circumferential side edges that are symmetrical in the lengthwise axial direction and concave toward the inside, so that there are formed in the mop holder a grip extending in the lengthwise direction at the central part thereof and a pair of mop holding parts having an arcuate tip and a horse-shoe-shaped bottom at both edges in the lengthwise direction integrally with said grip; the bottom surfaces of said mop holding parts being positioned below the grip; the lateral size of said grip being smaller than that of said mop holding parts; said mop holder having resiliency and flexibility sufficient to deflect a pair of mop holding parts inwardly and downwardly; said mop swab being composed of an oval base cloth, a number of mop cords fastened to the lower surface of said base cloth and impregnated with a dusting oil composition, and a pair of pockets provided at the upper surface and at both ends in the lengthwise direction of said base cloth; a pair of said holding parts of said mop holder being inserted into the pockets of said mop swab to attach the mop swab to the mop holder; said mop holder in a state attached to the mop swab having a curvature larger than that in a free state; and a space sufficient to insert the fingers of the operator being formed between the grip and the base cloth.

According to the present invention, the holder is not composed of a grip and separate mop holding parts that were so far employed, but is formed integrally of a foamed product of a plastic material or a rubber having mop holding parts at both ends, said holding parts being of a shape resembling a ginkgo nut leaf and having a surface like a tortoise shell, said both holding parts being narrowed in a curved manner at the opposing sides toward insides thereof and linked together by a central grip which is of the shape of a bar. Said central part rises beyond the holding parts at both ends and is formed in a size suited for gripping by hand; therefore, said central part can be used as a grip. The mop holder of the invention is fitted to the mop swab with the semicircular tips of holding parts on both sides being inserted in crescent-shaped bags provided at both ends of canvas of the mop swab. When thus fitted, the holder will rise more at its central part owing to the resiliency thereof, and the distance across the tips of the holding parts will be contracted a little as compared with the original distance, whereby the mop swab is held taut and allowed to undergo deformation in conformity with the curved surfaces of the object being cleaned.

Structure and effects of the handy mop of the invention are illustrated below in detail with reference to the accompanying drawings in which:

FIG. 1 is a perspective view of the mop holder of the present invention seen from the above;

FIG. 2 is a plan view of said mop holder;

Figure 3:
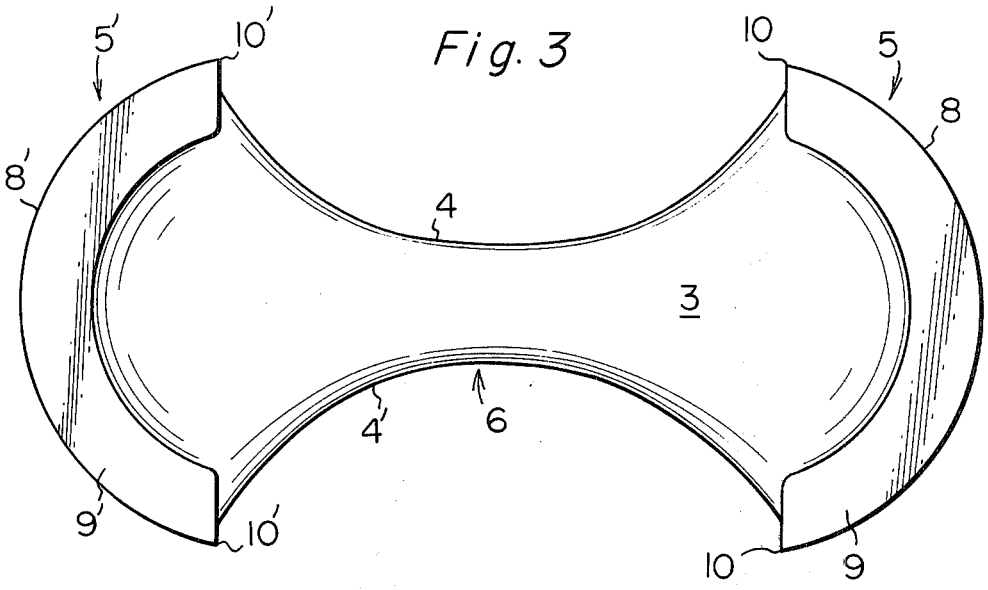
FIG. 3 is a bottom view of said mop holder.
Figure 4:
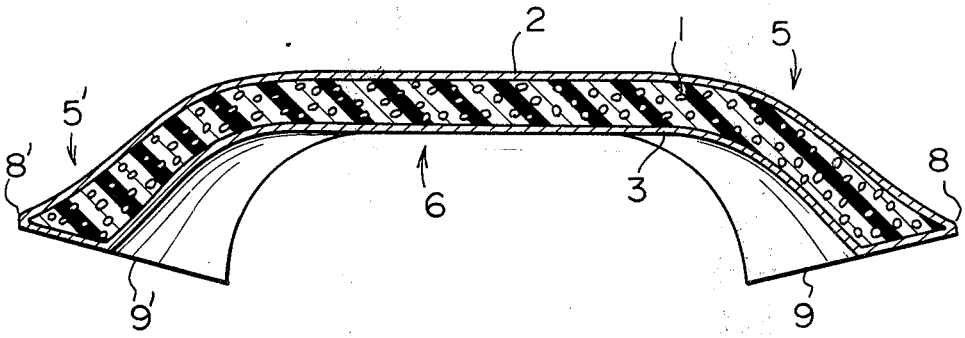
FIG. 4 is a cross-sectional side view of said mop holder shown in FIG. 2 taken along the line IV—IV.

Referring to FIGS. 1 to 5, and especially FIG. 4 which shows the cross section, the mop holder of the present invention is integrally molded of a synthetic resin or an elastomer, and has independent cells 1 inside thereof and non-permeable continuous skin layers 2 and 3 on the outer surfaces. The upper surface 2 and the lower surface 3 of the mop holder constitute spherical surfaces that are concavo-convex upwardly. The mop holder also has circumferential side edges 4 and 4' that are symmetrical in the lengthwise axial direction and convex inwardly. In this way, the mop holder is integrally provided with a pair of mop holding parts 5, 5' at both tips in the lengthwise direction and a grip 6 at the central part.

As is apparent from the drawings, the mop holding parts 5 and 5' constitute a shape resembling a ginkgo nut leaf, bonded integrally to the grip 6, and are so formed as to make a tortoise shell-shaped concavo-convex body as a whole.

Figure 5:
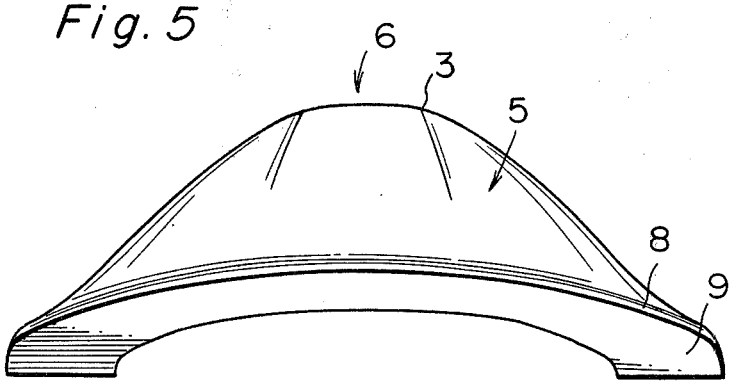
FIG. 5 is a front view of said mop holder.
Figure 7:
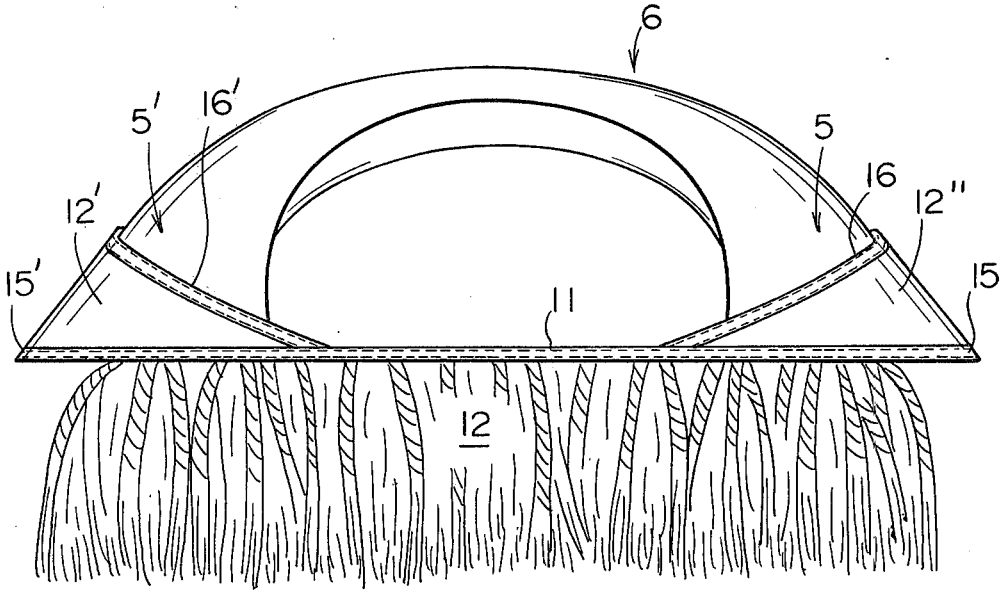
FIG. 7 is a side view showing a state in which said mop holder is fitted to said mop swab.

The mop holding parts 5 and 5' are quite symmetrical with respect to the central part 6, i.e., grip 6, and are narrowed gradually toward the center, and are bonded integrally to both sides of the narrow center, i.e., grip 6. The holder is formed, for example, in a thickness of about 1 to 2.5 cm, to have a sufficient strength as a holder, though the holder need not be equal in the thickness over the entire surface. It will be advantageous to provide a reinforcing rib for the purpose of enhancing the strength in the lengthwise direction. For example, obtuse-angled convex ribs 7, 7' may be disposed on the upper surface of said holder in the lengthwise direction to connect the holding parts 5 and 5'. Such ribs are selected appropriately depending upon the desired appearance and the like. For the same reason, convex or recessed ribs may be provided on the lower surface of the holder. However, attention should be given so that a bad feeling will not be given to the hand when the central grip 6 is gripped by hand. The holding parts 5, 5' are of an arcuate or semicircular shape at the ends 8, 8' being convex outwardly, and said convex ribs 7, 7' are widened at the ends of the mop holding parts 5, 5'. Furthermore, on the mop holding parts 5, 5' horse-shoe-shaped bottom faces 9, 9' are formed by cutting a spherical shell from a point above the center, as best shown in FIG. 3. Here, when the holder is not fitted to the mop, i.e., in a free state, the surface containing one horse-shoe-shaped bottom surface 9 is not in flush with the surface that contains the other horse-shoe-shaped face 9'; namely it crosses said other surface at an angle smaller than 180°, preferably 5° to 30° smaller than 180°, at a position below the holder, as shown in FIGS. 4 and 5. However, when fitted to the mop, the two surfaces will be in flush with each other as shown in FIG. 7.

Further, as shown in FIG. 4, the bottom surfaces 9, 9' of the mop holding part are positioned at a level below the central grip 6, and the outer surface 2 of the holder and the bottom surfaces 9, 9' are formed in an acute angle so that the semicircular peripheral tips 8, 8' will be inserted easily in the pockets of the mop swab which will be mentioned later.

Being made of a foamed product of a plastic material or an elastomer, the mop holder has sufficient flexibility and resiliency, whereby the pair of mop holding parts 5 and 5' can be deflected inwardly in the longitudinal directions and downwardly, and the lateral tips 10 and 10 ( 10' and 10' ) at the connecting portions between the peripheral tips 8, 8' of the mop holding parts and the peripheral cuts 4, 4' can be deflected laterally and inwardly. Thus, it is possible to easily insert the holding parts 5, 5' of the mop holder into the mop holder into the mop swab and to give uniform tension to the mop swab set in the holder in the direction of the surface. From the above standpoint, it is desirable to make the thickness of the mop holding parts 5, 5' smaller than the thickness at the central part 6 of the mop holder.

Figure 6:
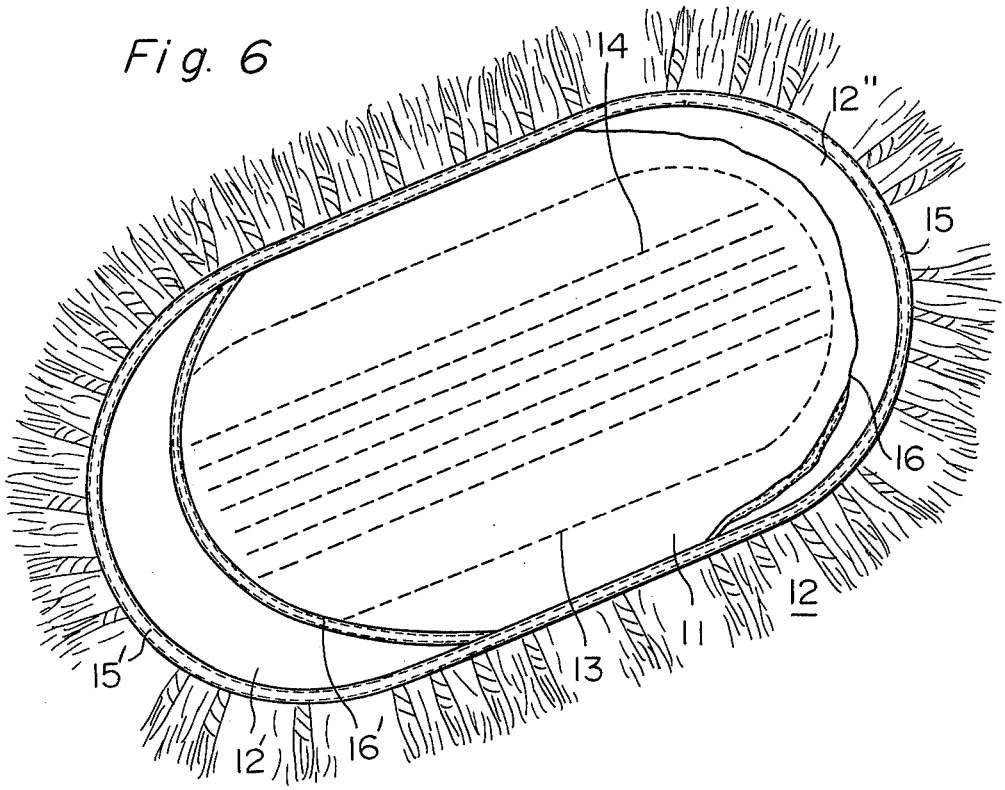
FIG. 6 is a perspective view of the mop swab of the present invention seen from the above.

As shown in FIG. 6, the mop swab used for the handy mop of the present invention has an oval base cloth to which are stitched mop cords 12 over the entire lower surface of the base cloth, preferably canvas 11 that has semi-circular end portions of a diameter nearly equal to that of the semicircles of said holders. The mop has on its upper surface the crescent-shaped canvasses 12', 12'' along the semicircular peripheries at both ends in the lengthwise direction. The inner sides of the canvasses 12', 12'' are not stitched but are open to form pockets. The mop cords 12 may be stitched to the canvas 11 by any means. For example, the mop cords composed of twisted yarns that are densely arrayed in parallel and in a plate-form cut in a definite length, may be stitched together at the central part to prepare a cord bundle, and then the bundle is stitched to the canvas 11 along the center line. Alternately, the cords may be tufted directly to the canvas 11, and the tufts may be fastened by stitching so as not to be pulled off easily. The cords can, for example, be stitched along the periphery of an oval canvas 11 shown in FIG. 6 to form a peripheral cord bundle, and, inside thereof, a number of cords can be formed densely by stitching or tufting 14 in the long- or short-diametered direction of the canvas 11 in parallel. The handy mop of the present invention is very effective for cleaning convex surfaces. To attain such cleaning effects, the length of the peripheral cords should be longer than the length of the inner cords. It is quite disadvantageous in cleaning operations to make an oval canvas using a hard plate, or to patch a hard plate such as a metal plate or a plastic plate onto the canvas. The convex arcuate peripheries 15, 15' on the outside of the cresent-shaped canvasses 12', 12'' are stitched together with the semicircular peripheries of said canvas 11, and on the other hand, the inner convex arcs are not stitched to the canvas 11. The inner convex arcs are floated above the surface of the canvas 11, thereby forming a pocket-like opening. The semicircular arcuate ends 8, 8' of the holding parts 5, 5' of said holder will just fit to the opposing crescent-shaped pockets 12', 12'' that are formed at the semicircular arcuate portions on both sides of the canvas 11. Therefore, the crescent-shaped open edges 16, 16' should be arranged so as to provide suitable conditions for receiving the rising tortoise-shell-shaped surface 2 of said holding parts.

To set the holder to said mop swab, the ginkgo-nut-leaf shaped mop holding parts 5, 5' on both sides of said holder are approached together, so that the tips 10 and 10 ( 10' and 10' ) on both sides approach each other, and the arcuate tips of the holding parts 5, 5' are inserted into said crescent-shaped pocket of the mop swab. Such an operation is quite easy. To release such engagement, the holder may simply be compressed.

FIG. 7 shows a side view of the assembled handy mop of the present invention. In this state, the holder looks a little contracted as compared with its original pattern; the aforesaid horse-shoe-shaped semicircular bottom surfaces 9, 9' are closely contacted with the upper surface of the canvas 11 and are in flush therewith. The canvas 11 is expanded on the lengthwise direction owing to the holding parts 5, 5' in the pockets and is held more tautly when the central part 6 is gripped by hand and pressed downward, thus being suited for cleaning operation.

The holder according to the present invention requires rubbery resiliency or flexibility. The mop swab of the present invention will be impregnated with a dusting oil as will be mentioned later, and therefore, said holder must be made of a material that is free from being dissolved or corroded by oils.

In view of the foregoing, the holder of the present invention should preferably be made of a plastic material or an elastomer having relatively large flexibility and resiliency. Examples may be polyolefin resins such as low-density polyethylenes, ethylene/propylene copolymers, styrene/butadiene copolymers, plastic materials such as vinyl chloride resins, ethylene/vinyl acetate copolymers, elastomers such as polyurethanes, acrylinitrile/butadiene rubbers, styrene/butadiene rubbers, ethylene/propylene non-conjugate diene rubbers, and silicone rubbers and the like. These plastic materials or elastomers may be compounded with known compounding agents such as foaming agents, foam stabilizers, cross-linking agents, vulcanizing agents, plasticizers, lubricants, pigments, fillers, anti-oxidants, ultraviolet ray absorbing agents, etc. according to known methods.

Furthermore, it is very important that the holder of the present invention should be made of a foamed material such as a plastic material or an elastomer having independent cells. The holder of the invention made of a foamed plastic material or an elastomer is light in weight, facilitates the cleaning operation, increases the resiliency required for the holder of the invention, and facilitates the setting and releasing operation of the mop, whereby the practical utility of the mop holder can be increased. However, the molded article loses it strength if the foaming rate is too increased; therefore, the volume expansion due to the foaming should be not more than about 3 times, preferably from about 1.5 to about 2.5 times. The appropriate foaming rate may be selected depending upon the kinds of plastic materials or elastomers employed. Foams suited for the holder of the present invention are small independent cells. The foamed holder of the invention can be easily produced by heating and kneading a composition in which are uniformly mixed a plastic material or an elastomer and a required amount of a foaming agent or a cross-linking agent or vulcanizing agent, injecting the composition into a metal mold of the form of a holder, and causing the foaming to take place in the metal mold or after being taken out of the metal mold. To make the holder of the present invention using a finely foamed material in very advantageous, because the amount of the plastic material used is saved, the weight of the holder is reduced and the flexibility of the holder is remarkably increased. Further, the holders can be more easily produced by injection molding or compression molding than by molding of non-foamed materials. In this way, the handy mop of the present invention is very advantageous industrially and practically.

The mop swab of the present invention will be impregnated with known dusting oil compositions. Essentially, the oil composition may be applied only to the mop cords below the surface of the canvas. Usually, however, the entire mop swab will be immersed in the oil composition. Hence, the entire mop structure such as cords, oval canvas, crescent-shaped canvas and stitched parts or stitching threads, should be made of an oil-resistant material such as cotton, rayon or mercerized cotton.

The dusting oil may comprise, for example, a mineral oil, a small amount of cationic surfactant or amphoteric surfactant, or a combination thereof and a nonionic surfactant. Such an oil will be applied by a conventional manner to the fibers in an amount of 10 to 30 % by weight based on the fiber.

The mop holder and the mop swab of the present invention, when combined as shown in FIG. 7, provide a construction suited for cleaning curved surfaces such as of automobiles. That is, between the grip 6 of the mop holder and the base cloth 11 is defined a space sufficient for inserting the fingers of a person who performs cleaning; therefore, the person who performs cleaning can easily hold the grip of the mop holder. The holder provides a constant tension to the entire surface of the mop swab, so that the mop cords are contacted with a considerably wide area of the surface being cleaned, and further, the mop swab is deformed to closely fit to the convex surfaces even when the surface being cleaned is convex, whereby dusting and polishing can be performed effectively.

What is claimed is:

1. A handy mop comprising a mop holder and a mop swab; said mop holder being composed of an integrally molded resilient, foamed product having independent cells inside thereof and a non-permeable continuous skin layer on the outer surface; said mop holder having a convex spherical upper surface and a concave spherical lower surface; said mop holder having sides that are symmetrical in the lengthwise axial direction and concave toward the inside, so that there is formed in the mop holder a grip extending in the lengthwise direction at the central part thereof and a pair of mop holding parts having an arcuate tip and a horse-shoe-shaped bottom at each end integrally with said grip; the bottom surfaces of said mop holding parts being positioned below the grip; the lateral size of said grip being smaller than that of said mop holding parts; said mop holder having resiliency and flexibility sufficient to enable the pair of mop holding parts to be deflected inwardly and downwardly; said mop swab being composed of an oval base cloth, a number of mop cords fastened to the lower surface of said base cloth and impregnated with a dusting oil composition, and a pocket provided at the upper surface and at each end of said base cloth; the holding parts of said mop holder being inserted into the pockets of said mop swab to attach the mop swab to the mop holder; said mop holder in a state attached to the mop swab having a curvature larger than that in a free state; and a space sufficient to insert the fingers of the operator being formed between the grip and the base cloth.

2. A handy mop according to the claim 1, wherein the surface including one horse-shoe-shaped bottom surface of said mop holder and the surface including other horse-shoe-shaped bottom surface are planar and intersect at an angle smaller than 180° at a position lower than the holder.

3. A handy mop according to the claim 2, wherein said two surfaces intersect at an angle smaller by 5° to 30° than 180°.

4. A handy mop according to the claim 1, wherein reinforcing ribs are provided in the lengthwise direction on the upper surface of said holder.

5. A handy mop according to the claim 1, wherein the pockets of said mop swab are formed by stitching a crescent-shaped cloth along the outer periphery on both ends of the base cloth on the upper surface and in the lengthwise direction, and the inner edge of the cloth forming said pockets lies above the surface of the base cloth to form a space that receives the mop holding parts of the handy mop.

6. A handy mop according to the claim 1, wherein the size in the lengthwise direction across the arcuate tips of said pair of mop holding parts of said mop holder, in its free state, is larger than the size in the lengthwise direction across the outer peripheral edges of a pair of pockets of said swab; and the lateral size across the tips in the lateral direction of the connecting part between the arcuate tips of said mop holder and the circumferential side edges is larger than the maximum size in the lateral direction of said pockets; whereby when said mop holder and said mop swab are combined together, so that tension is given to said mop swab in the lengthwise direction and the lateral direction.

* * * * *